US011777195B2

(12) United States Patent
Chang et al.

(10) Patent No.: US 11,777,195 B2
(45) Date of Patent: Oct. 3, 2023

(54) MOBILE DEVICE FOR ENHANCING ANTENNA STABILITY

(71) Applicant: Acer Incorporated, New Taipei (TW)

(72) Inventors: Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 26 days.

(21) Appl. No.: 17/567,321

(22) Filed: Jan. 3, 2022

(65) Prior Publication Data

US 2023/0054603 A1 Feb. 23, 2023

(30) Foreign Application Priority Data

Aug. 18, 2021 (TW) ..... 110130460

(51) Int. Cl.
*H01Q 1/24* (2006.01)
*H01Q 5/364* (2015.01)
*H01Q 9/04* (2006.01)

(52) U.S. Cl.
CPC ..... *H01Q 1/243* (2013.01); *H01Q 5/364* (2015.01); *H01Q 9/0421* (2013.01)

(58) Field of Classification Search
CPC ..... H01Q 1/243; H01Q 5/364; H01Q 9/0421
See application file for complete search history.

(56) References Cited

U.S. PATENT DOCUMENTS 10,069,196 B1 * 9/2018 Yen ..... H01Q 1/243
10,910,696 B2 2/2021 Chang et al.
2011/0260929 A1 * 10/2011 Ali ..... H01Q 9/0421 343/788
2015/0255854 A1 * 9/2015 Lin ..... H01Q 1/243 343/702
2016/0118710 A1 * 4/2016 Shin ..... H01Q 1/243 343/702
2016/0190699 A1 * 6/2016 Yang ..... H01Q 1/243 343/700 MS
2020/0243962 A1 * 7/2020 Lo ..... H01Q 5/10
2021/0126355 A1 * 4/2021 Chuang ..... H01Q 1/243
2022/0190465 A1 6/2022 Chang et al.

FOREIGN PATENT DOCUMENTS

TW 202032851 A 9/2020
TW I704720 B 9/2020
TW 202103368 A 1/2021
TW I736487 B 8/2021

OTHER PUBLICATIONS

Chinese language office action dated Jun. 17, 2022, issued in application No. TW 11120591140.

* cited by examiner

*Primary Examiner* — Hai V Tran
*Assistant Examiner* — Michael M Bouizza
(74) *Attorney, Agent, or Firm* — McClure, Qualey & Rodack, LLP

(57) ABSTRACT

A mobile device for enhancing antenna stability includes a nonconductive frame, a back cover, a PIFA (Planar Inverted F Antenna), and a U-shaped ground element. The PIFA is disposed between the nonconductive frame and the back cover. The U-shaped ground element is coupled to the PIFA, and is at least partially attached to the nonconductive frame. The vertical projection of the PIFA at least partially overlaps the U-shaped ground element.

13 Claims, 7 Drawing Sheets

MOBILE DEVICE FOR ENHANCING ANTENNA STABILITY

CROSS REFERENCE TO RELATED APPLICATIONS

This application claims priority of Taiwan Patent Application No. 110130460 filed on Aug. 18, 2021, the entirety of which is incorporated by reference herein.

BACKGROUND OF THE INVENTION

Field of the Invention

The disclosure generally relates to a mobile device, and more particularly, it relates to a mobile device for enhancing antenna stability.

Description of the Related Art

With the advancements being made in mobile communication technology, mobile devices have become more common. Mobile devices usually have wireless communication functions.

Antennas are indispensable elements for wireless communication. If an antenna used for signal reception and transmission has insufficient stability, it will negatively affect the communication quality of the mobile device. Accordingly, it has become a critical challenge for antenna designers to design a wideband, small-size antenna element with high stability.

BRIEF SUMMARY OF THE INVENTION

In an exemplary embodiment, the disclosure is directed to a mobile device for enhancing antenna stability. The mobile device includes a nonconductive frame, a back cover, a PIFA (Planar Inverted F Antenna), and a U-shaped ground element. The PIFA is disposed between the nonconductive frame and the back cover. The U-shaped ground element is coupled to the PIFA, and is at least partially attached to the nonconductive frame. The vertical projection of the PIFA at least partially overlaps the U-shaped ground element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
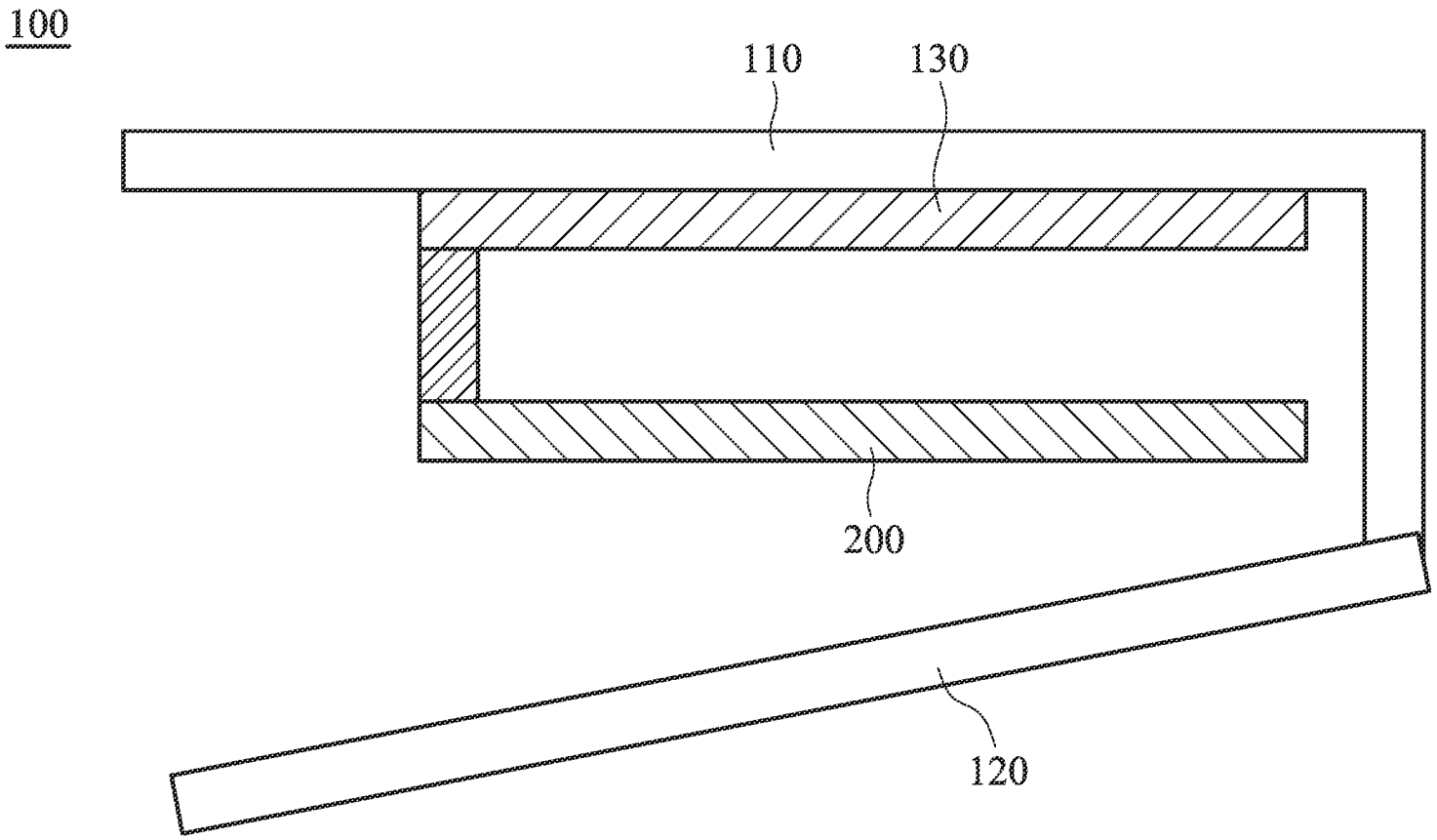
FIG. 1 is a sectional view of a mobile device according to an embodiment of the invention.

FIG. 1 is a sectional view of a mobile device 100 according to an embodiment of the invention. For example, the mobile device 100 may be a smartphone, a tablet computer, or a notebook computer. As shown in FIG. 1, the mobile device 100 includes a nonconductive frame 110, a back cover 120, a PIFA (Planar Inverted F Antenna) 200, and a U-shaped ground element 130. The back cover 120 may be made of a conductive material or a nonconductive material. The PIFA 200 and the U-shaped ground element 130 may both be made of metal materials, such as copper, silver, aluminum, iron, or their alloys. It should be understood that the mobile device 100 may further include other components, such as a processor, a touch control panel, a speaker, a battery module, and a housing, although they are not displayed in FIG. 1.

For example, if the mobile device 100 is a notebook computer, the nonconductive frame 110 may be the so-called "C-component" in the field of the notebook computer, and the back cover 120 may be the so-called "D-component" in the field of the notebook computer. The nonconductive frame 110 is connected to the back cover 120 in such a way that there is a hollow region between them. In some embodiments, the nonconductive frame 110 is the keyboard frame of the notebook computer. Furthermore, the back cover 120 may have a cutting-retraction design, such that the back cover 120 is at least partially not parallel to the nonconductive frame 110.

Both the PIFA 200 and the U-shaped ground element 130 are disposed inside the hollow region between the nonconductive frame 110 and the back cover 120. The U-shaped ground element 130 is coupled to the PIFA 200, and is at least partially attached to the nonconductive frame 110. The PIFA 200 has a vertical projection on the nonconductive frame 110, and the vertical projection at least partially overlaps the U-shaped ground element 130. With such a design, since it is unnecessary to couple the PIFA 200 to the back cover 120, the freedom and stability of the antenna design of the mobile device 100 can be significantly improved.

The following embodiments will introduce the detail structural features of the mobile device 100. It should be understood that these figures and descriptions are merely exemplary, rather than limitations of the invention.

Figure 2:
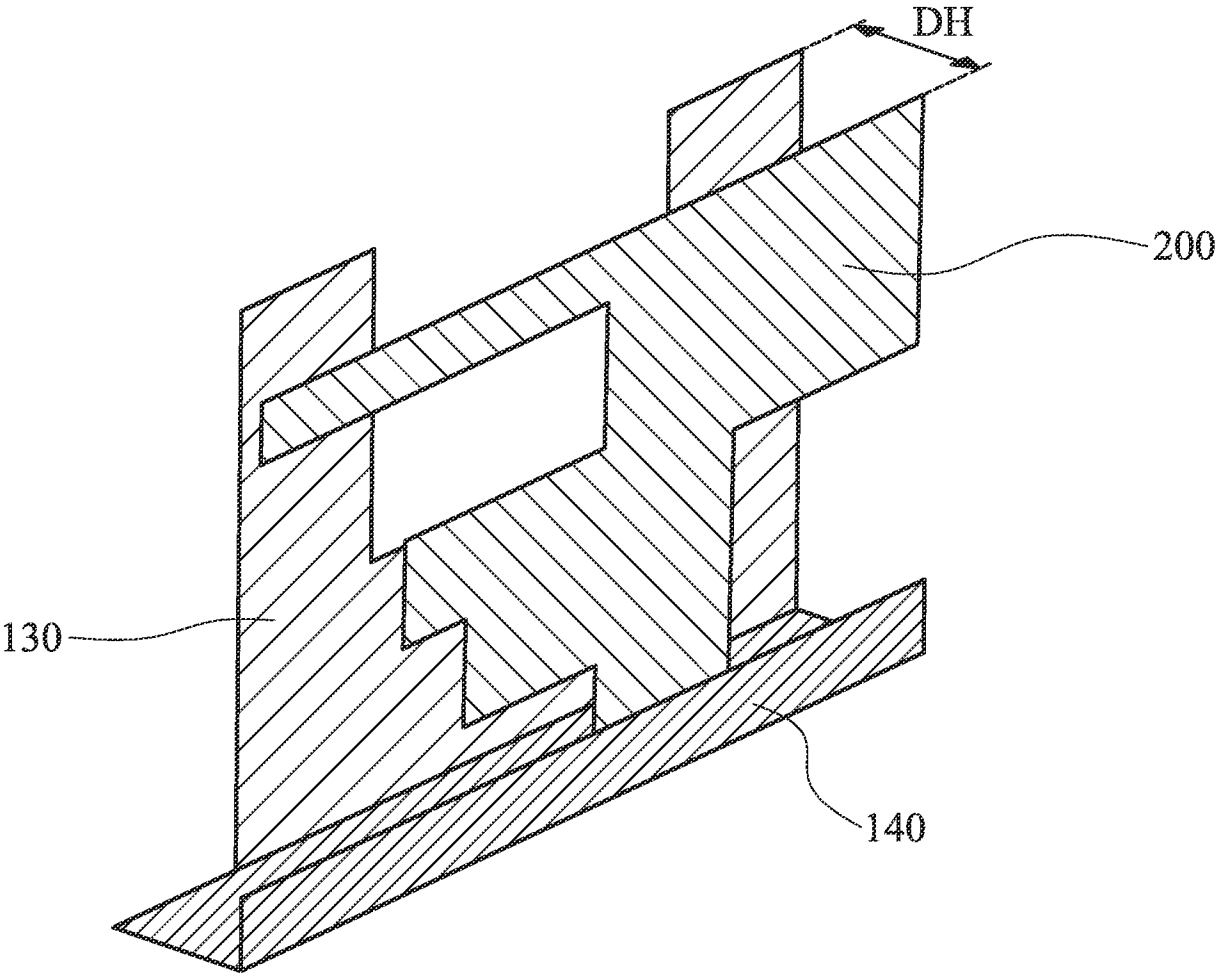
FIG. 2 is a partial perspective view of a mobile device according to an embodiment of the invention.

FIG. 2 is a partial perspective view of the mobile device 100 according to an embodiment of the invention. In the embodiment of FIG. 2, the mobile device 100 further includes a ground connection element 140, which may be made of a metal material. The ground connection element 140 may have a bending structure. The ground connection element 140 is coupled between the PIFA 200 and the U-shaped ground element 130, such that the PIFA 200 and the U-shaped ground element 130 are substantially parallel to each other.

Figure 3:
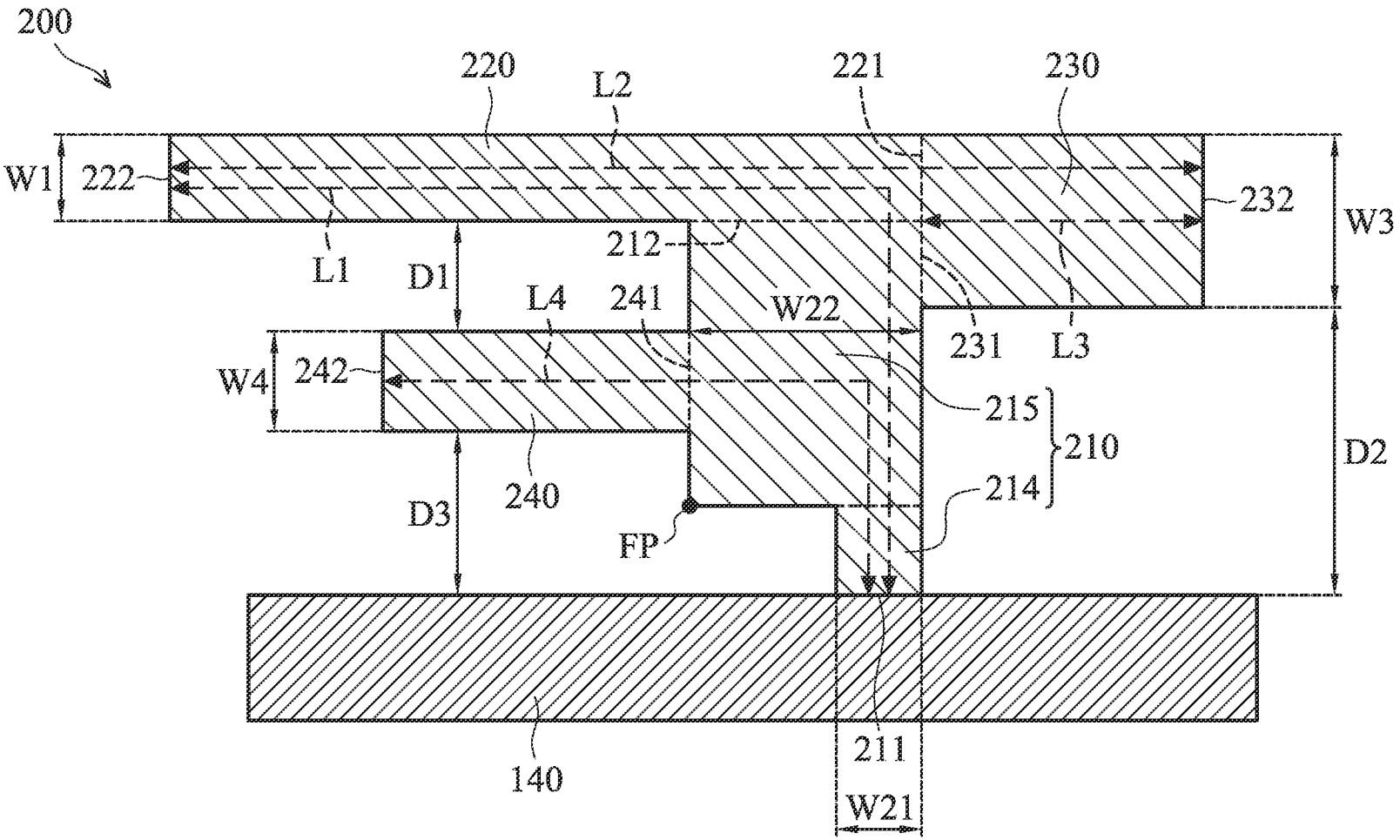
FIG. 3 is a top view of a PIFA (Planar Inverted F Antenna) according to an embodiment of the invention.

FIG. 3 is a top view of the PIFA 200 according to an embodiment of the invention. In the embodiment of FIG. 3, the PIFA 200 includes a feeding radiation element 210, a first radiation element 220, a second radiation element 230, and a third radiation element 240.

The feeding radiation element 210 may substantially have a variable-width straight-line shape. Specifically, the feeding radiation element 210 has a first end 211 and a second end 212. The first end 211 of the feeding radiation element 210 is coupled to the ground connection element 140. In some embodiments, the feeding radiation element 210 includes a narrow portion 214 adjacent to the first end 211 and a wide portion 215 adjacent to the second end 212. The wide portion 215 is coupled through the narrow portion 214 to the ground connection element 140. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing is reduced to 0). A feeding point FP is positioned at a corner of the wide portion 215 of the feeding radiation element 210. The feeding point FP may be further coupled to a signal source (not shown). For example, the signal source may be an RF (Radio Frequency) module for exciting the PIFA 200.

The first radiation element 220 may substantially have a narrow straight-line shape, and it may be substantially perpendicular to the feeding radiation element 210. Specifically, the first radiation element 220 has a first end 221 and a second end 222. The first end 221 of the first radiation element 220 is coupled to the second end 212 of the feeding radiation element 210. The second end 222 of the first radiation element 220 is an open end.

The second radiation element 230 may substantially have a wide straight-line shape, and it may be substantially perpendicular to the feeding radiation element 210. Specifically, the second radiation element 230 has a first end 231 and a second end 232. The first end 231 of the second radiation element 230 is coupled to the second end 212 of the feeding radiation element 210 and the first end 221 of the first radiation element 220. The second end 232 of the second radiation element 230 is an open end. For example, the second end 232 of the second radiation element 230 and the second end 222 of the first radiation element 220 may substantially extend in opposite directions and away from each other.

The third radiation element 240 may substantially have a narrow straight-line shape, and it may be substantially perpendicular to the feeding radiation element 210. Specifically, the third radiation element 240 has a first end 241 and a second end 242. The first end 241 of the third radiation element 240 is coupled to the wide portion 215 of the feeding radiation element 210. The second end 242 of the third radiation element 240 is an open end. For example, the second end 242 of the third radiation element 240 and the second end 222 of the first radiation element 220 may substantially extend in the same direction.

Figure 4:
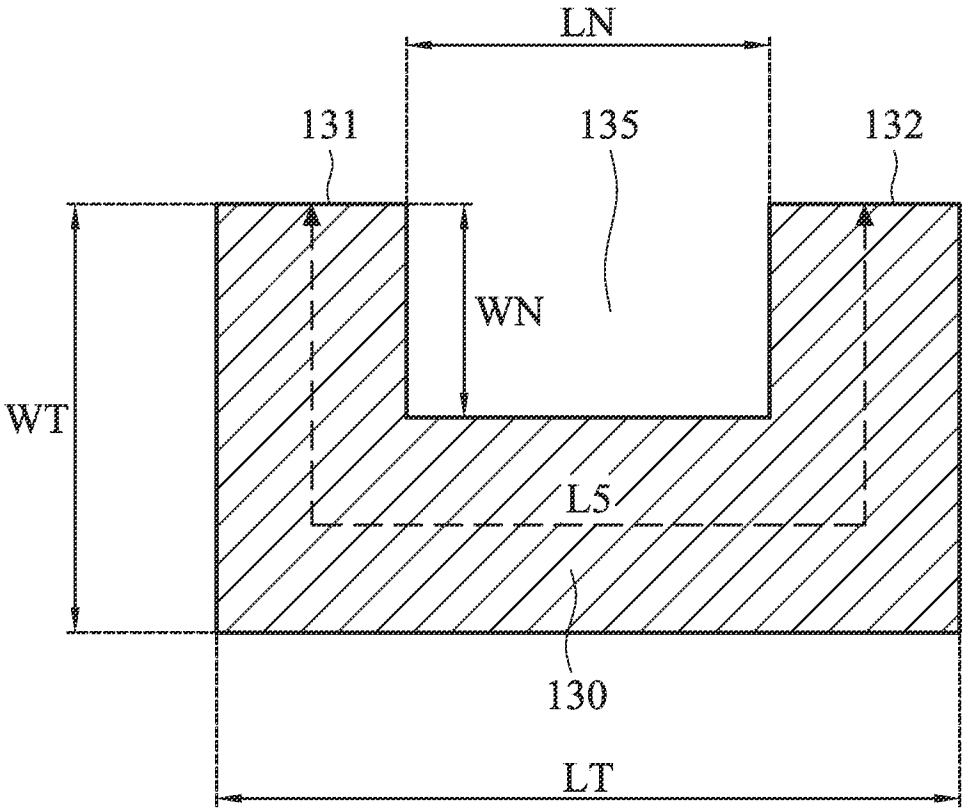
FIG. 4 is a top view of a U-shaped ground element according to an embodiment of the invention.

FIG. 4 is a top view of the U-shaped ground element 130 according to an embodiment of the invention. In the embodiment of FIG. 4, the U-shaped ground element 130 has a first open end 131 and a second open end 132. A notch region 135 is formed between the first open end 131 and the second open end 132 of the U-shaped ground element 130. For example, the notch region 135 may substantially have a rectangular shape.

Figure 5:
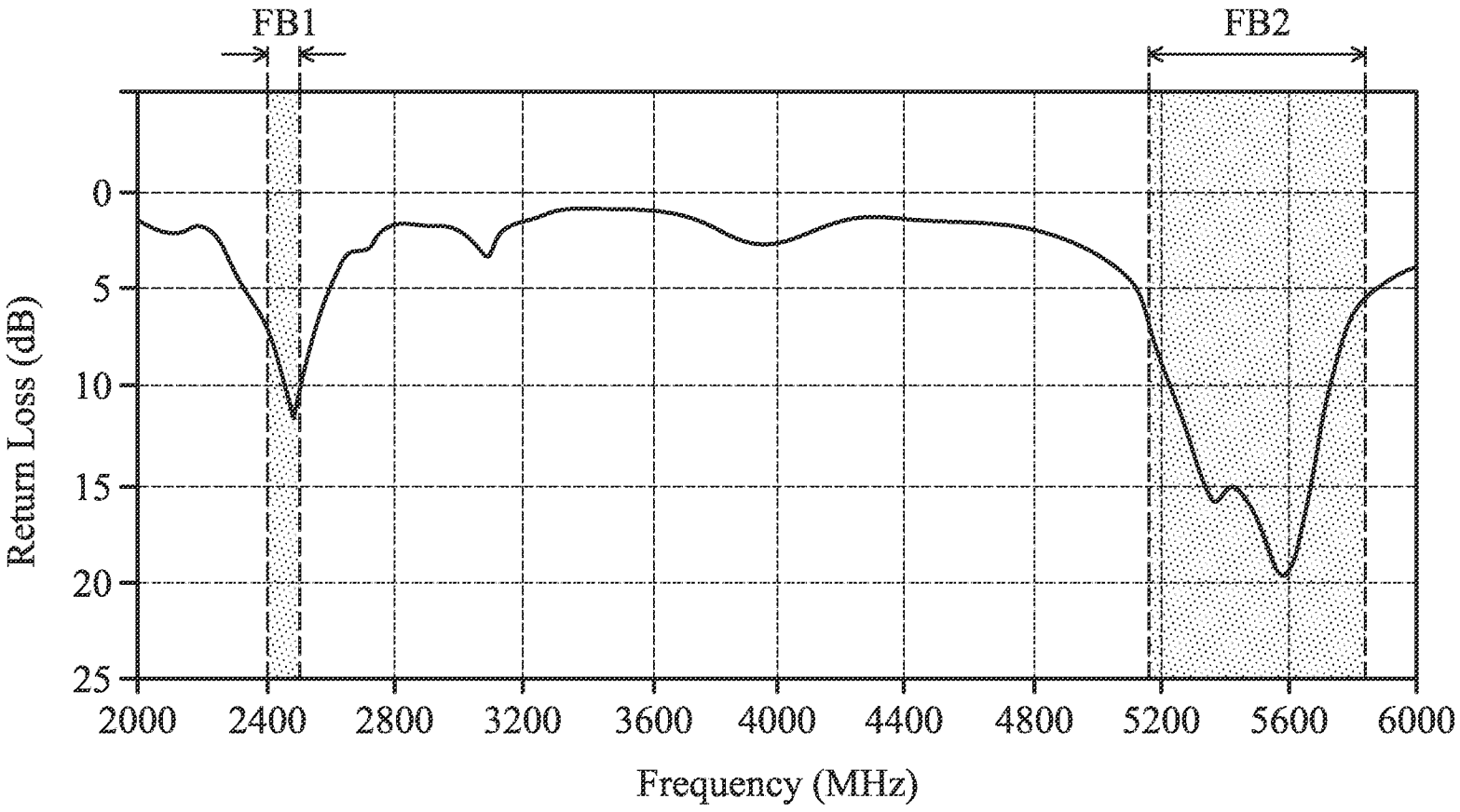
FIG. 5 is a diagram of return loss of a PIFA of a mobile device according to an embodiment of the invention.

FIG. 5 is a diagram of return loss of the PIFA 200 of the mobile device 100 according to an embodiment of the invention. The horizontal axis represents the operational frequency (MHz), and the vertical axis represents the return loss (dB). As shown in FIG. 5, the PIFA 200 can cover a first frequency band FB1 and a second frequency band FB2. The first frequency band FB1 may be from 2400 MHz to 2500 MHz. The second frequency band FB2 may be from 5150 MHz to 5850 MHz. Therefore, the mobile device 100 can support at least the wideband operations of WLAN (Wireless Local Area Networks) 2.4 GHz/5 GHz.

In some embodiments, the operational principles of the mobile device 100 are described below. The feeding radiation element 210 and the first radiation element 220 can be excited together to generate the first frequency band FB1. The feeding radiation element 210, the first radiation element 220, the second radiation element 230, and the third radiation element 240 can be excited together to generate the second frequency band FB2. Furthermore, the U-shaped ground element 130 can fine-tune the impedance matching of the first frequency band FB1 and the second frequency band FB2, thereby increasing its operational bandwidth.

Figure 6:
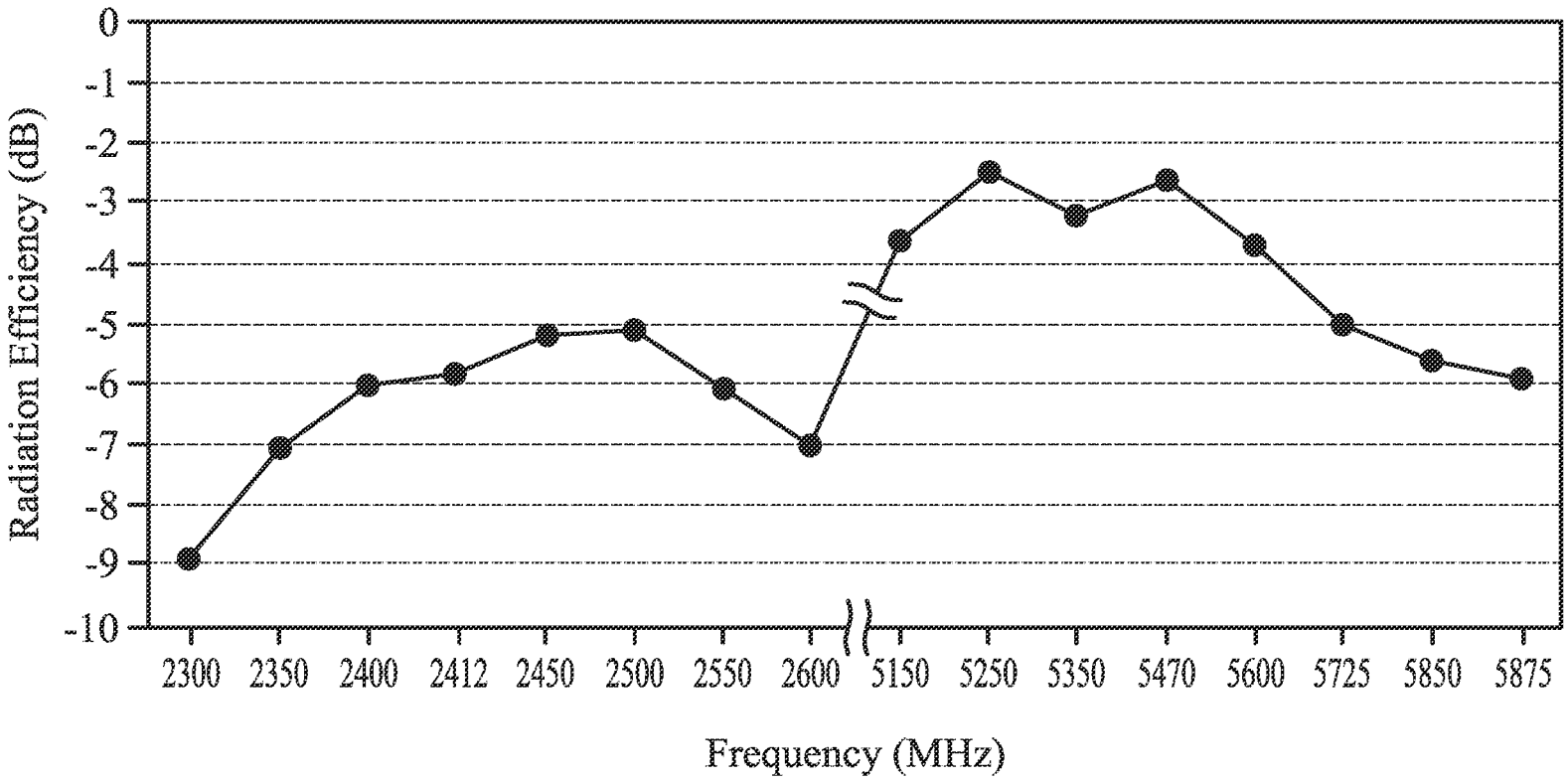
FIG. 6 is a diagram of the radiation efficiency of a PIFA of a mobile device according to an embodiment of the invention.

FIG. 6 is a diagram of the radiation efficiency of the PIFA 200 of the mobile device 100 according to an embodiment of the invention. The horizontal axis represents the operational frequency (MHz), and the vertical axis represents the radiation efficiency (dB). According to the measurement of FIG. 6, the radiation efficiency of the PIFA 200 of the mobile device 100 can reach −6 dB or higher within the first frequency band FB1 and the second frequency band FB2. It can meet the requirement of general mobile communication devices.

In some embodiments, the element sizes of the mobile device 100 are described below. The total length L1 of the feeding radiation element 210 and the first radiation element 220 may be substantially equal to 0.25 wavelength (λ/4) of the first frequency band FB1 of the PIFA 200. The width W1 of the first radiation element 220 may be from 2 mm to 3 mm. In the feeding radiation element 210, the width W21 of the narrow portion 214 may be from 1 mm to 2 mm, and the width W22 of the wide portion 215 may be from 4 mm to 5 mm. The total length L2 of the first radiation element 220 and the second radiation element 230 may be substantially equal to 0.5 wavelength (λ/2) of the second frequency band FB2 of the PIFA 200. The length L3 of the second radiation element 230 may be substantially equal to 0.167 wavelength (λ/6) of the second frequency band FB2 of the PIFA 200. The width W3 of the second radiation element 230 may be from 4 mm to 5 mm. The total length L4 of the feeding radiation element 210 and the third radiation element 240 may be substantially equal to 0.25 wavelength (λ/4) of the second frequency band FB2 of the PIFA 200. The width W4 of the third radiation element 240 may be from 2 mm to 3 mm. The distance D1 between the first radiation element 220 and the third radiation element 240 may be from 2 mm to 3 mm. The distance D2 between the second radiation element 230 and the ground connection element 140 may be longer than 5 mm. The distance D3 between the third radiation element 240 and the ground connection element 140 may be from 1 mm to 3 mm. In the U-shaped ground element 130, the path length L5 from the first open end 131 to the second open end 132 may be substantially equal to 0.5 wavelength (λ/2) of the first frequency band FB1 of the PIFA 200. The length LN of the notch region 135 may be from 0.33 to 0.5 times the total length LT of the U-shaped ground element 130. The width WN of the notch region 135 may be substantially a half of the total width WT of the U-shaped ground element 130. The distance DH between the PIFA 200 and the U-shaped ground element 130 may be from 3 mm to 4 mm. The above ranges of element sizes are calculated and obtained according to the results of many experiments, and they help to optimize the operational bandwidth and impedance matching of the PIFA 200 of the mobile device 100.

Figure 7:
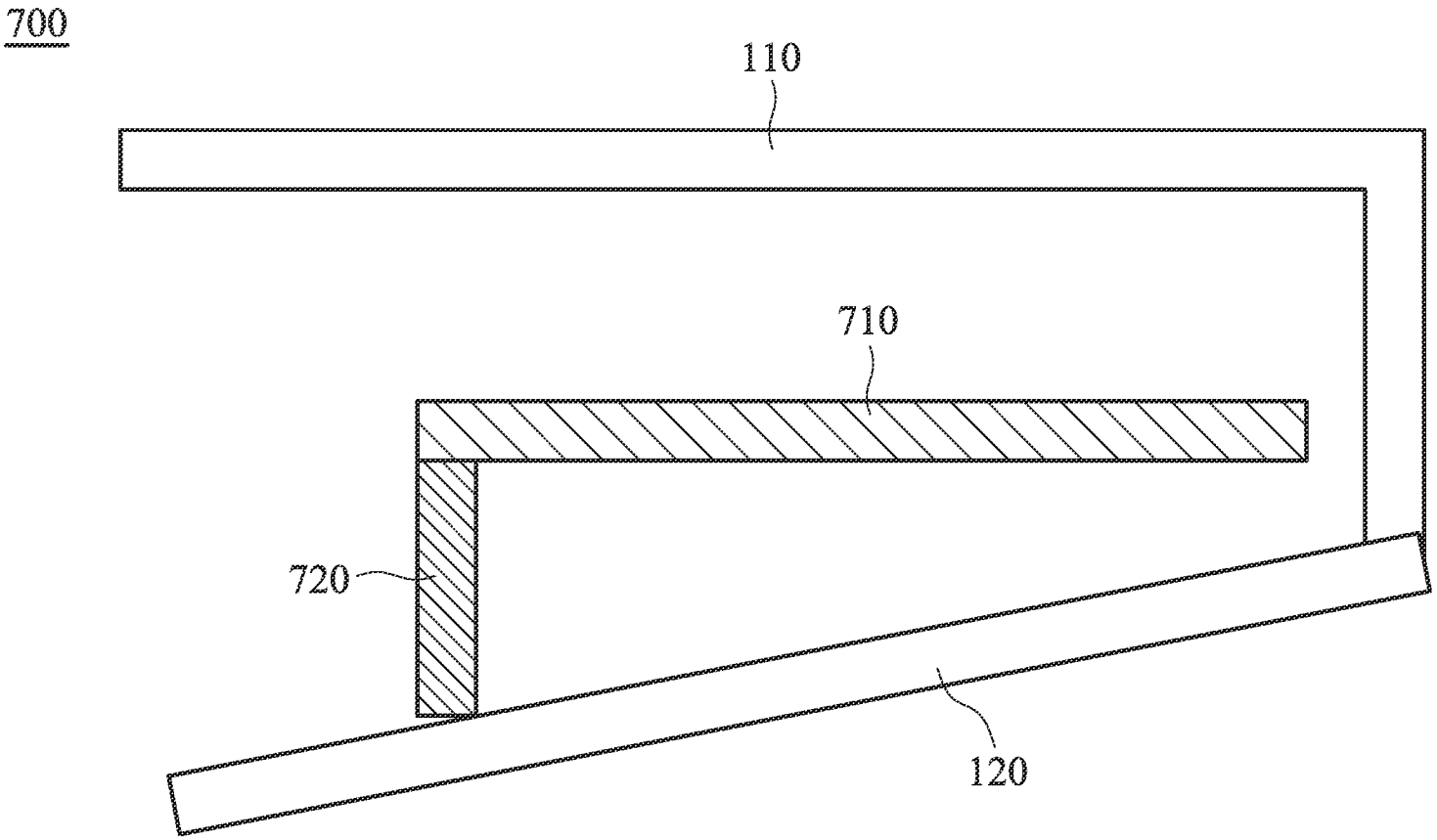
FIG. 7 is a sectional view of a mobile device according to another embodiment of the invention.

FIG. 7 is a sectional view of a mobile device 700 according to another embodiment of the invention. In the embodiment of FIG. 7, the mobile device 700 includes a nonconductive frame 110, a back cover 120, an antenna 710, and a conductive gasket 720. It should be noted that if the conductive gasket 720 supports the antenna 710, the stability of the antenna 710 may be negative affected on the condition that aging or deformation happens to the conductive gasket 720. To solve this problem, the embodiments of FIGS. 1 to 6 of the invention replace the conductive gasket 720 with the U-shaped ground element 130, thereby significantly improving the radiation performance and stability of the antenna.

The invention proposes a novel mobile device, which includes a U-shaped ground element. In comparison to the conventional design, the invention has at least the advantages of small size, wide bandwidth, low manufacturing cost, and high stability. Therefore, it is suitable for application in a variety of mobile communication devices.

Note that the above element sizes, element shapes, and frequency ranges are not limitations of the invention. An antenna designer can fine-tune these settings or values according to different requirements. It should be understood that the mobile device of the invention is not limited to the configurations of FIGS. 1-7. The invention may merely include any one or more features of any one or more embodiments of FIGS. 1-7. In other words, not all of the features displayed in the figures should be implemented in the mobile device of the invention.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile device for enhancing antenna stability, comprising:

a nonconductive frame;

a back cover;

a PIFA (Planar Inverted F Antenna), disposed between the nonconductive frame and the back cover; and a U-shaped ground element, coupled to the PIFA, and at least partially attached to the nonconductive frame;

wherein a vertical projection of the PIFA at least partially overlaps the U-shaped ground element;

wherein the mobile device further comprises:

a ground connection element, coupled between the PIFA and the U-shaped ground element, such that the PIFA and the U-shaped ground element are substantially parallel to each other;

wherein the PIFA comprises:

a feeding radiation element, having a feeding point, and coupled to the ground connection element;

wherein the feeding radiation element comprises a narrow portion and a wide portion, the feeding point is positioned at the wide portion, and the wide portion is coupled through the narrow portion to the ground connection element.

2. The mobile device as claimed in claim 1, wherein the PIFA further comprises:

a first radiation element, coupled to the feeding radiation element;

a second radiation element, coupled to the feeding radiation element and the first radiation element, wherein the second radiation element and the first radiation element substantially extend in opposite directions; and a third radiation element, coupled to the feeding radiation element, wherein the third radiation element and the first radiation element substantially extend in a same direction.

3. The mobile device as claimed in claim 2, wherein the first radiation element substantially has a narrow straight-line shape, and the second radiation element substantially has a wide straight-line shape.

4. The mobile device as claimed in claim 2, wherein the PIFA covers a first frequency band and a second frequency band, the first frequency band is from 2400 MHz to 2500 MHz, and the second frequency band is from 5150 MHz to 5850 MHz.

5. The mobile device as claimed in claim 4, wherein a total length of the feeding radiation element and the first radiation element is substantially equal to 0.25 wavelength of the first frequency band.

6. The mobile device as claimed in claim 4, wherein a total length of the first radiation element and the second radiation element is substantially equal to 0.5 wavelength of the second frequency band.

7. The mobile device as claimed in claim 4, wherein a total length of the feeding radiation element and the third radiation element is substantially equal to 0.25 wavelength of the second frequency band.

8. The mobile device as claimed in claim 4, wherein the U-shaped ground element has a first open end and a second open end, and a path length from the first open end to the second open end is substantially equal to 0.5 wavelength of the first frequency band.

9. The mobile device as claimed in claim 2, wherein a width of the first radiation element is from 2 mm to 3 mm.

10. The mobile device as claimed in claim 2, wherein a width of the second radiation element is from 4 mm to 5 mm.

11. The mobile device as claimed in claim 2, wherein a width of the third radiation element is from 2 mm to 3 mm.

12. The mobile device as claimed in claim 1, wherein a width of the narrow portion of the feeding radiation element is from 1 mm to 2 mm.

13. The mobile device as claimed in claim 1, wherein a width of the width portion of the feeding radiation element is from 4 mm to 5 mm.

* * * * *